United States Patent [19]

Schmidt

[11] 4,407,029

[45] Oct. 4, 1983

[54] RECLINING PLATFORM FOR BATHTUB UNITS

[76] Inventor: Peter Schmidt, D-7989 Enkenhofen, Gde. Argenbühl, Fed. Rep. of Germany

[21] Appl. No.: 398,055

[22] Filed: Jul. 14, 1982

[30] Foreign Application Priority Data

Apr. 3, 1982 [EP] European Pat. Off. ..... 82102874

[51] Int. Cl.[3] ..... A47K 3/12

[52] U.S. Cl. ..... 4/564; 4/580; 5/12 C; 5/431

[58] Field of Search ..... 4/495, 501, 559, 560, 4/564–566, 571, 573, 575, 578–581, 546–548, 551; 5/12 C, 431

[56] References Cited

U.S. PATENT DOCUMENTS

| | | | |
|---|---|---|---|
| 2,725,578 | 12/1955 | Keller | 4/565 |
| 3,106,723 | 10/1963 | Carpenter | 4/564 |
| 3,892,000 | 7/1975 | Morse | 4/580 |

*Primary Examiner*—Stephen Marcus
*Assistant Examiner*—Kenneth S. Putnam
*Attorney, Agent, or Firm*—Angelo Notaro

[57] ABSTRACT

A reclining platform for bathtub units has a rectangular-shaped reclining platform and four hinged plates joined to the side edges of said reclining platform by means of hinges. The hinges are equipped with springs that press the hinged plates into the same plane as the base plate. The hinged plates can pivot upwards against the tension of the built-in springs. The entire reclining platform has a mat, which forms wedges at the corner recesses between each two hinged plates. The mat consists of a flexible material.

The reclining platform covers the entire length of the bathtub, without folds, when the unit is in raised position. When the unit is lowered, the hinged plates abut tightly against the tub walls, and the wedges are folded up and close off the rounded corners of the walls as well. The new unit ensures that handicapped persons cannot get caught.

10 Claims, 6 Drawing Figures

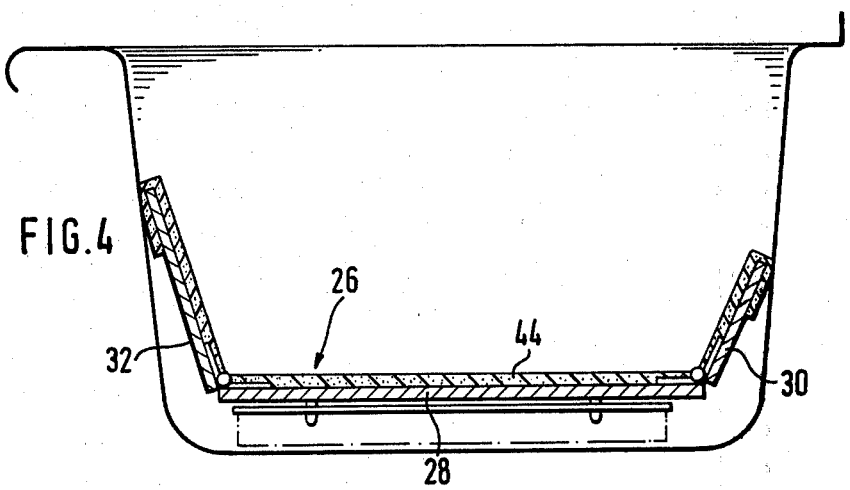
FIG.4
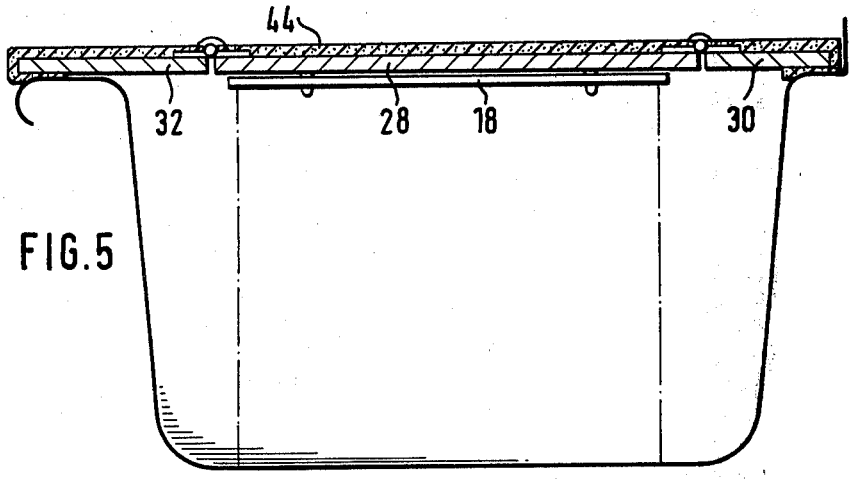
FIG.5
FIG.6
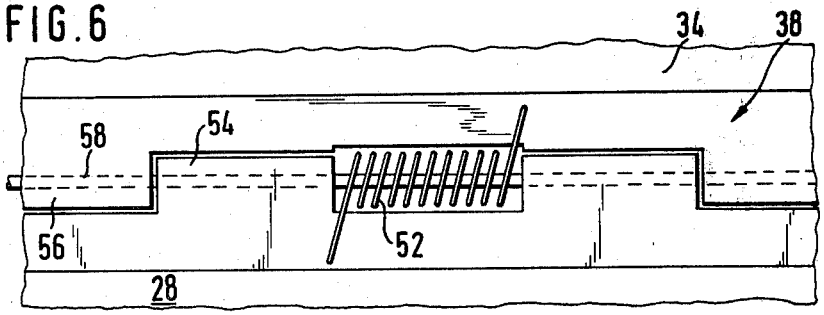

RECLINING PLATFORM FOR BATHTUB UNITS

BACKGROUND OF THE INVENTION

The invention concerns a reclining platform for bathtub units for handicapped persons in particular, consisting of a base, a bracket plate, and a lift frame and lift device positioned between them.

Seat platforms for handicapped persons, which can be moved up and down by a lift frame, are known. In practice, however, such a bathtub unit has not proved worthwhile, because the handicapped person can only sit, not lie down, and particularly because there is a considerable risk of injury, for in lowering and raising the seat platform the handicapped person can get his hands and feet caught between the platform and the bathtub.

SUMMARY OF THE INVENTION

It is therefore the aim of the invention to create a new reclining platform for such bathtub units that will guarantee a fit as close as possible to the tub walls in any kind of lift device, so that all gaps are essentiallyclosed.

According to the invention this aim is achieved in that the reclining platform consists of an oblong base plate that is essentially rectangular, and four hinged plates positioned at its front and side edges and pivotable upward; that one front hinged plate is wider, measured in the longitudinal direction of the base plate, than the front hinged plate opposite it; that all hinged plates are held close to the stop faces of the base plate by means of springs, and thus lie at least approximately on a common plane that coincides with the plane of the base plate; and that the corner recesses between every two adjacent hinged plates are at least partially filled by wedges that bend flexibly and/or expand.

In one embodiment of the invention, the top of the base plate and all four hinged plates are covered by a single-unit, pliable pad that forms the wedges in the corner recesses. The pad thus has a curved external contour in the area of the wedges, the radial extension of the recess being shorter than the width of the adjoining hinged plates. Another advantageous characteristic is that the corners of the base plate and those two corners of each hinged plate that border on the base plate are rounded or beveled.

The invention provides the advantage that in raised position of the bathtub unit a flat reclining area is formed for the handicapped person which overlaps the edges of the bathtub, so that no crevices are formed. If the unit is lowered, the four hinged doors fold upward against the effect of the return springs and are held in position on the inside surface of the bathtub by the spring tension. Since one front end of the customary bathtubs inclines more than the opposite end, the hinged plate must accordingly be wider here, in order to ensure initial complete coverage of the tub. The folding or pliable wedges ensure that even the round corners of the bathtub will be covered, with these wedges accordingly moving into position in accordance with the upward swivelling of the hinged doors. Because of the somewhat narrower radial extension compared with the width of the adjoining hinged plates, the wedges automatically fold up. Thus the handicapped person cannot unintentionally get his arms or legs into a corner recess that would otherwise exist, whereupon bruises would inevitably be caused if the plate were lowered further.

Additional characteristics and advantages of the invention appear from the following description of one embodiment in connection with the drawing.

BRIEF DESCRIPTION OF THE DRAWING

FIG. 4 a cross section through the bathtub with a reclining platform in lowered position;

FIG. 5 a cross section similar to FIG. 4, but with the reclining platform in raised position; and FIG. 6 a plan view of a hinge with built-in spring attached between the base plate and the hinged plate.

DETAILED DESCRIPTION

Figure 1:
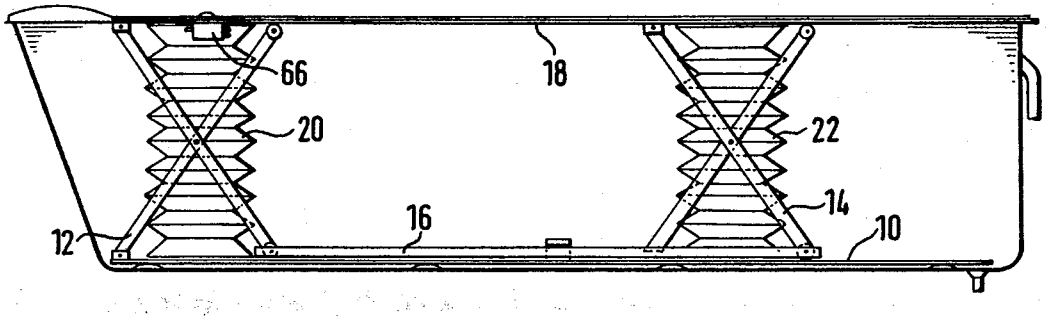
FIG. 1 shows a diagrammatic side view of a bathtub unit for which the new reclining platform is designed.

FIG. 1 illustrates the basic construction of a bathtub unit consisting of base plate 10, two lift frames 12, 14 connected by guide 16, a bracket plate 18 that is activated vertically by the supporting frames, two lift devices 20, 22 in the form of hydraulic pressure bellows and a manual operation valve 66 under the bracket plate, which has three water connections. One is connected by a hose to the building water system, another is connected with the two bellows 20, 22, and the third is connected to the tub drain. Thus the user can control the rising and falling of the bracket plate without exerting his own strength.

Figure 3:
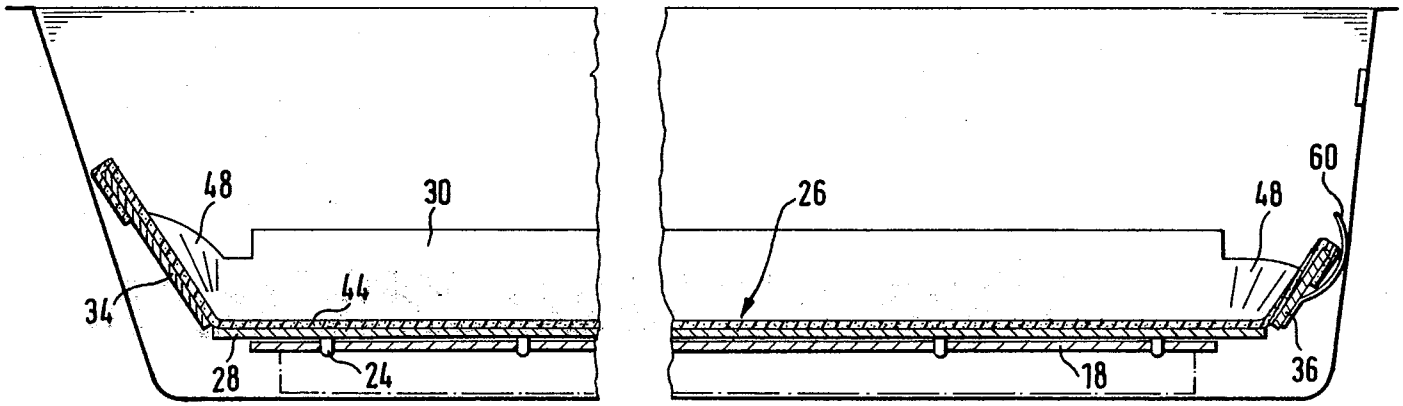
FIG. 3 a longitudinal section through a bathtub with a reclining platform in lowered position.
Figure 2:
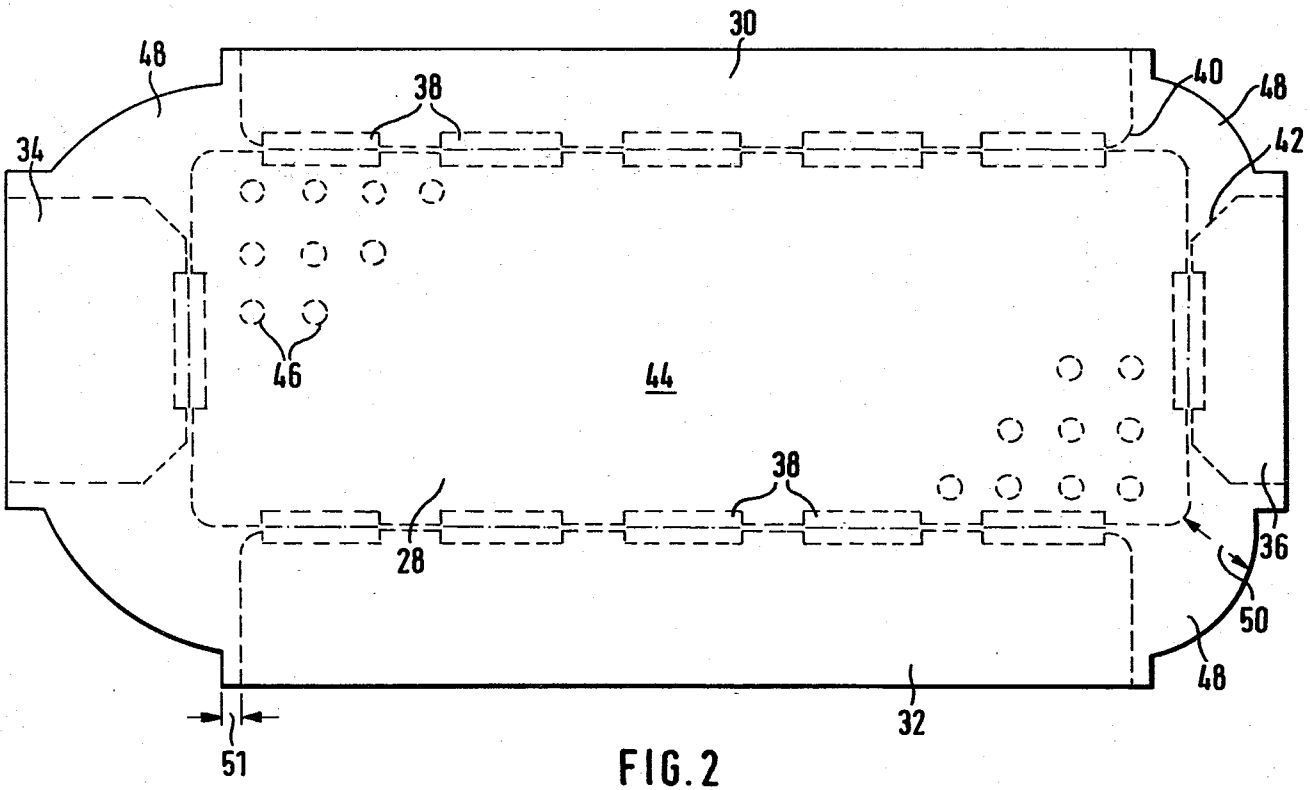
FIG. 2 a plan view of the reclining platform.

As appears from FIGS. 2 and 3, a removable platform 26 is attached tc support bracket 18 by means of pins 24, which said platform consists of a rectangular base plate 28 with rounded corners, two side hinged plates 30, 32, and two front hinged plates 34,36. All hinged plates 30–36 are connected by means of hinge frames or hinge-frame sections 38 on the top of the plate with the base plate 28, in such manner that the plates can swivel upward but not downward below the level of the base plate. Adjacent edges of the base plate and the hinged plate abut one another when both plates lie in the same plane.

The side hinged plates 30, 32, are somewhat shorter than the length of base plate 28, and the front hinged plates 34, 36 are similarly somewhat shorter than the width of base plate 28. Also important is the fact that the two corners facing the base plate on each hinged plate are rounded or beveled. Rounding-off 40 is recommended for the side hinged plates. For the front hinged plates, bevelings are illustrated that have a purpose to be described later. The side hinged plate 30 is narrower than the opposite side hinged plate 32, because in the customary built-in bathtubs the side hinged plate 32 serves as a front plate that rests on the entire width of the tub edge and overlaps it when necessary. The handicapped person uses this plate 32 and if necessary the end section of base plate 28 as a temporary seat before he takes his place on the reclining platform. For plate 30 a narrower width is sufficient, because it need only cover the tub crevice. The front hinged plate 36 is as wide as the narrow side wall hinged plate 30. It overlaps the tub edge at the foot. Opposite end hinged plate 34 is considerably wider than opposite end hinged plate 36. It serves as cover plate and closes the tub top despite the slope of the head end wall.

The entire reclining platform, consisting of base plate 28 and the four hinged plates 30–36, is covered by a single-unit mat 44. The mat consists preferably of a piece of foam rubber that has a certain cushion effect and has a number of perforations. In this connection it can be mentioned that the base plate also has a number of perforations 46.

Mat 44 is longer and wider than the reclining platform, and is turned by 180° over the outer edges of the four hinged plates and is detachably attached on the undersides of the hinged plates, preferably with cloth tie strips. Mat 44 also has on its underside cloth strip sections that work together with corresponding tie strip sections mounted on the hinges 38. The mat is thereby ensured against slipping and is protected from the hinges. The corner recesses between each two adjoining hinged plates are covered partially by wedge 48 of the mat. To facilitate the automatic folding of this wedge 48 when the reclining platform is lowered, these wedges have a radial extension 50 that is narrower than the hinged plates adjoining each. It is also provided that the wedges do not extend directly to the narrow edges of the hinged plates, but rather that the mat 44 overhangs the full width of the narrow edges by amount 51. This construction facilitates the folding up of wedge 48.

When the bathtub unit is in the bottommost position according to FIG. 4, hinged plates 30–36 are folded upward and are pressed against the tub edges by springs that try to swivel the hinged plates downward. Although various embodiments of springs, for example flat springs for the upward-directed stress of the hinged plates, can be used, it has proved particularly advantageous to build operating lever springs 52 into the hinge 38, in such manner that according to FIG. 6 one or more clamp straps positioned at an interval can be removed from the alternating interlocking clamp straps 54, 56 of the two hinge frame parts and can be replaced by an operating lever spring 52, which is penetrated by the hinge rod of the hinge frame. In compressed position the operating lever spring is positioned in such manner that it presses hinged plate 34 into the same geometric plane as base plate 28.

Because of the flexible hinged plates, no gap can unintentionally occur between the upper edges of the plates and the tub walls. Almost complete closure of the rounded tub edges between the end wall of the tub and the side walls of the tub is achieved by means of collapsible wedge 48. Thus the outer contour of the reclining platform essentially fits the inner contour of the tub perfectly.

If the reclining platform is now raised, the hinged plates 30–36 swivel outward and make contact with the edge of the tub. When the uppermost position for climbing in and out is reached, all hinged plates are swiveled into position in the plane of the base plate and rest on the edges of the tub. The entire tub is covered by the reclining platform, without a gap.

In FIG. 3 a recoil clamp 60 is shown on the underside at the foot-end hinged plate 36, which said recoil clamp prevents this hinged plate from locking onto the top tub drain.

As initially indicated, the round-off 40 and beveled 42 corners on the base-plate-side corners of hinged plates 30–36 serve to facilitate the folding of the mat 44 in the wedge areas.

I claim:

1. A reclining platform for bathtub units, of the type having a base, a bracket plate, and a lift frame and lift device positioned between the base and bracket plate, the reclining platform comprising an oblong, essentially retangular base plate extended in a plane and four hinged plates positioned at front and side edges of the base plane and pivotable upward; one front hinged plate being wider, measured in the longitudinal direction of the base plate, than the front hinged plate opposite it; spring means holding all of the hinged plates close to the base plate for urging the hinged plates to lie at least approximately on a common plane that coincides with the plane of base plate; every two adjacent hinged plates having recesses therebetween and wedges at least partially filled into the recesses, said wedges being flexible.

2. The reclining platform according to claim 1, wherein the base plate and all four hinged plates have top surfaces, and further comprising a single unit, flexible mat including the wedges in corners of the mat, and wherein the base plate and all four hinged plates are covered by the mat.

3. The reclining platform according to claim 2, wherein the mat has a curved outer contour in the wedge area, and wherein the wedge has a radius at the curved outer contour shorter than the width of the adjacent hinged plates.

4. The reclining platform according to claim 1, wherein the corners of the base plate and the corners of each hinged plate that abut the base plate are rounded.

5. The reclining platform according to claim 1, wherein the length of the said hinged plates is less than the length of base plate and the length of the front hinged plates is less than the width of the base plate.

6. The reclining platform according to claim 3, wherein the mat includes overhanging sections which overhang both narrow edges of the hinged plates, and that the wedges, are connected with these overhanging sections.

7. The reclining platform according to claim 1, wherein at least the base plate has a plurality of perforations.

8. The reclining platform according to claim 1, wherein the base plate is removably attached to the bracket plate of the lift frame.

9. The reclining platform according to claim 2, wherein the mat is turned by 180° over the outer edges of hinged plates and is removably attached to the undersides of the hinges plates.

10. The reclining platform according to claim 1, comprising hinge means connecting the hinged plates with the base plate, said hinge means comprising frames attached to the top of the hinged plates and at least one of alternating interlocking clamp straps having a common hinge rod extended therethrough being removed and a prong spring through which the hinge rod runs, mounted in place of said removed clamp strap the spring having one prong supported on the base plate and another prong supported on one of the hinged plates attached thereto.

* * * * *